US005141220A

United States Patent [19]

Ettischer

[11] Patent Number: 5,141,220

[45] Date of Patent: Aug. 25, 1992

[54] APPARATUS FOR DEPOSITING COPY SHEETS

[75] Inventor: Helmut Ettischer, Ostfildern, Fed. Rep. of Germany

[73] Assignee: Eastman Kodak Company, Rochester, N.Y.

[21] Appl. No.: 615,115

[22] Filed: Nov. 19, 1990

[30] Foreign Application Priority Data

Dec. 15, 1989 [DE] Fed. Rep. of Germany ..... 3941477

[51] Int. Cl.[5] ..... B65H 31/20

[52] U.S. Cl. ..... 271/213; 271/223

[58] Field of Search ..... 271/184, 213, 223, 225, 271/278-279, 302-303, 306; 414/798.2, 900

[56] References Cited

U.S. PATENT DOCUMENTS

| | | | |
|---|---|---|---|
| 3,421,755 | 1/1969 | Brozo | 271/68 |
| 4,073,487 | 2/1978 | Schirrmeister et al. | 271/279 |
| 4,077,519 | 3/1978 | Huber | 271/279 |
| 4,261,559 | 4/1981 | Mitzel | 271/184 |
| 4,444,388 | 4/1984 | Stefannson et al. | 271/225 |
| 4,747,493 | 5/1988 | Nakanishi | 271/225 |
| 4,930,765 | 6/1990 | Russel et al. | 271/214 |

FOREIGN PATENT DOCUMENTS

| | | |
|---|---|---|
| 2758044 | 7/1978 | Fed. Rep. of Germany . |
| 3010788 | 11/1980 | Fed. Rep. of Germany . |
| 1-62677 | 6/1989 | Japan . |

OTHER PUBLICATIONS

IBM Tech. Dis. Bull. vol. 17, #9, Feb. 1975; pp. 2535-2536.

IBM Tech. Dis. Bull. vol. 17, #9, Feb. 1975; pp. 2559-2560.

Patent Abstracts of Japan M-549; Dec. 25, 1986; vol. 10, #388; JP 61-178367.

*Primary Examiner*—David H. Bollinger

*Attorney, Agent, or Firm*—Tallam I. Nguti

[57] ABSTRACT

An apparatus for depositing copy sheets comprises a collecting bin (6, 15) which in the sheet entry direction is arranged in a downwardly inclined position and is provided with a stop member (14) associated with the leading edge of the sheets. The trailing-edge portion of the sheets is associated with a guide element (19) directing incoming sheets onto the top of the sheet stack already deposited.

Above the sheet stack to be formed rollers (22) forming part of a sheet entry path, are arranged, associated with the trailing-edge portion of the sheets to be deposited, and are driven in sheet entry direction. The periphery or surface area of the rollers (22) facing the sheet stack (23, 23*a*) lies beneath the drop-off point in the entry plane of the sheets as determined by the guide element (19) to the extent that such periphery or surface area holds or confines the top of the sheet stack (23, 23*a*) in a recessed position beneath the sheet drop-off point in the entry plane, thereby keeping the feed path of subsequent incoming sheets open. If due to sheet curling the stack of sheets (23*a*) already deposited contacts the rollers (22), the incoming sheets move between rollers (22) and the topmost sheet onto the top of the sheet stack (23*a*) and are advanced by the rollers (22).

6 Claims, 1 Drawing Sheet

APPARATUS FOR DEPOSITING COPY SHEETS

BACKGROUND OF THE INVENTION

1. Field of the Invention

The invention relates to an apparatus for depositing sheets, particularly copy sheets produced by a copier, which are individually fed seriatim into a bin and collected there in stacked relation, said bin having a depositing surface and a stop means located at the lead-edge end of the depositing surface for registering the leading edge of the incoming sheets, and means defining a sheet entry path including at least one guide element arranged opposite said stop means, that is, terminating immediately before the trail-edge end of the depositing surface, for directing the sheets fed to the bin onto those already deposited.

2. Description Relative to the Prior Art

During their passage through the copier, copy sheets are subjected to differing stress by heat, pressure, static charge, etc., thereby being more or less curled. As a result, the trailing portion of the stack of deposited copy sheets turns up to the extent that further sheet deposition is obstructed.

It is known from DE-OS 27 58 044 to guide the sheets entering a collecting bin in such a way that they are fed onto the sheet stack in a curved path. The incoming sheets are thereby directed over the turned-up edges of the sheets already deposited, which, however, requires a considerable increase of the overall height of the collecting bin.

In conjunction with a collecting bin arranged at an inclined position, it is known from DE-OS 30 10 788 to devide the depositing surface for the copy stack into areas of differing inclination. The area facing the sheet entry is somewhat more inclined than the remaining areas so that the sheets deposited are turned down in this area to the extent that they do not prevent the following sheets from entering. It can, however, not be excluded with respect to this apparatus that deposited sheets do not turn down as expected before the next sheet enters so that further deposition of copies is obstructed.

SUMMARY OF THE INVENTION

It is an object of the invention to provide an apparatus of the above-mentioned type in which unobstructed sheet deposition at a space-saving construction is warranted.

According to the invention, the object is attained in that in the above apparatus for depositing the sheet stack (23, 23*a*) within the collecting bin (6), at least one rotatable roller (22) is arranged which is associated with the trailing or trail-edge portion of the sheet stack (23, 23*a*) facing the guide element (19) and is driven to contact an incoming sheet in sheet entry direction, and whose peripheral portion or surface facing the depositing surface, and hence facing the sheet stack (23, 23*a*) thereon, lies beneath the entry plane or drop-off point of the sheets as determined by the guide element (19) to the extent that the roller (22) limits the top and trailing portion, respectively, of the sheet stack (23, 23*a*) in a recessed position beneath the sheet entry plane, or drop-off point, thereby keeping the feed path of subsequent incoming sheets open.

In an advantageous embodiment of the invention the roller is arranged, or mounted, at a small distance from the guide element of the collecting bin so as to hold or confine the trail-edge portions of both long and short sheets in such a recessed position in order to keep the feed path of subsequent incoming sheets open.

Appropriately, the collecting bin has a downwardly slanting orientation or is arranged at a downwardly inclined position in the sheet entry direction whereby due to gravity the sheets slide off the drop-off point into the collecting bin without the use of additional transport means. Moreover, the slant or inclined position of the bin reduces the overall size of the apparatus in an advantageous manner.

A further advantageous development of the invention is that the roller, relative to the trail-edge end of the depositing surface, can be movable adjustably so as to effectively handle a range of different sheet formats.

The design of the apparatus according to the invention warrants unobstructed sheet deposition at a space-saving construction.

BRIEF DESCRIPTION OF THE DRAWINGS

Further features and advantages will be apparent from the description of an embodiment of the invention shown in the drawing and from the subclaims. The drawing show in a schematic representation a side view of the apparatus in cross-section.

DETAILED DESCRIPTION OF THE PREFERRED EMBODIMENT

Figure 1:
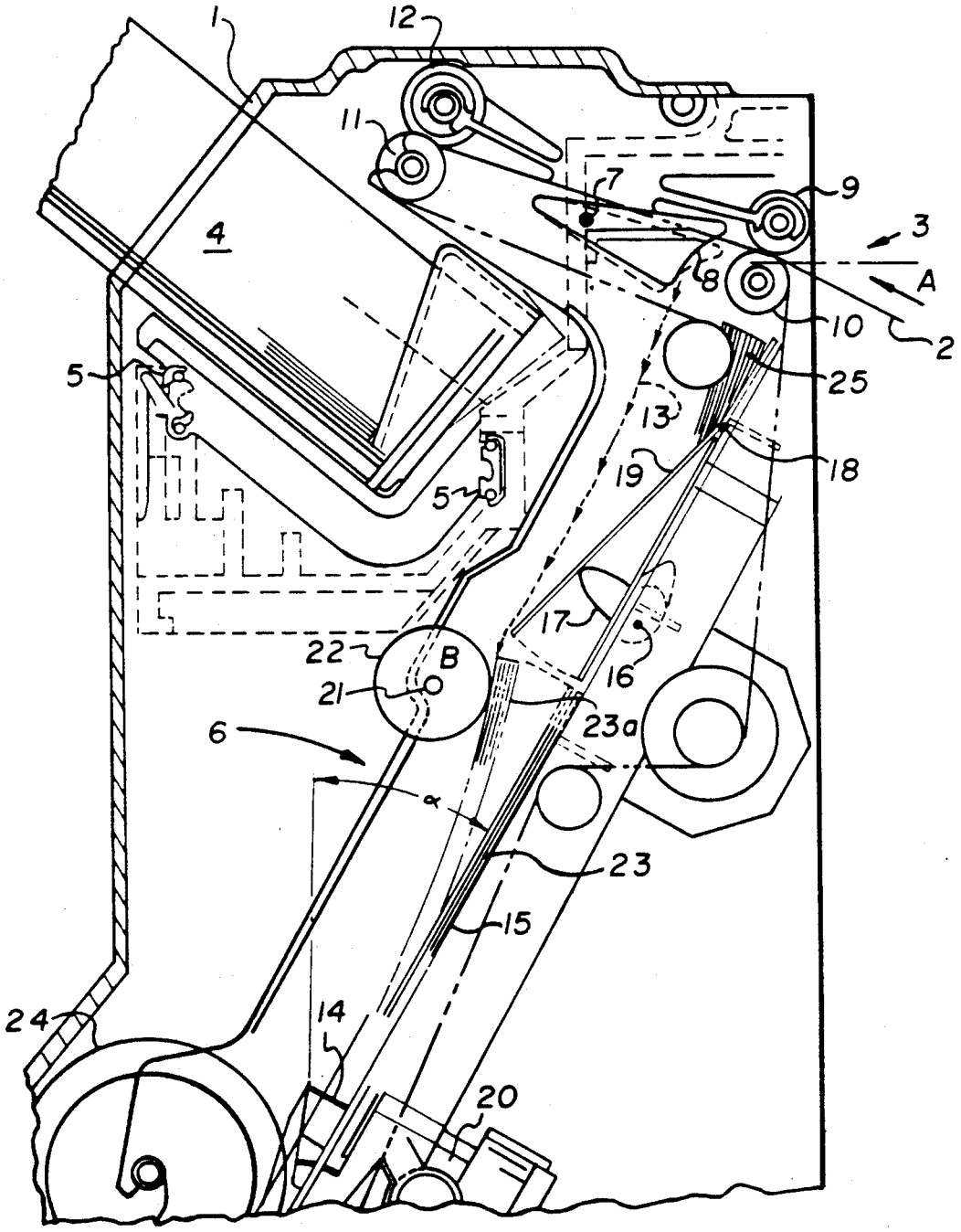

The invention will be described with respect to a finisher in which copy sheets can be stacked either individually or in sets in an offset manner, or in which the sets of copy sheets are stapled and the stapled copy sets are stacked.

The finisher according to the invention is arranged in a housing 1 which, with its side featuring an entry section 3, is connected to the output side of a copier (not illustrated) from which individual copy sheets—in the following simply called sheets—are successively fed, seriatim, to the entry section (direction of arrow "A").

In housing 1 an upper bin 4 is arranged which is used for collecting loosely stacked, non-stapled sheets.

In order to deposit the sheets in sets in an offset manner, the upper bin 4 is designed for movement on sliding guides 5 transversely to the sheet entry direction thereinto.

Moreover, housing 1 comprises a collecting bin 6 which is used for collecting sheets to be stapled in sets.

In a further bin which is not illustrated, the finished sets of sheets are deposited.

Collecting bin 6 is arranged at an angle $\alpha$ of less than 45 degrees in a downwardly slanting orientation, or a downwardly inclined position, in the sheet entry direction thereby permitting the sheets to drop into the bin 6 by gravity.

Selection of the desired paper path either to the upper bin 4 or to the collecting bin 6 is effected by means of a diverter 8 that can be pivoted about pin 7.

When diverter 8 is in its dash-dotted position, the sheets are fed to the upper bin 4 by means of transport rollers 9, 10 and 11, 12 on a substantially rectilinear path and deposited in the bin or stacked therein in sets in an offset manner.

If stapled sets of copies are to be made, diverter 8 is moved to the position shown in solid lines in the drawing. The sheets entering in the direction of arrow "A" are then engaged by the transport rollers 9, 10 arranged in the entry section 3 and guided downwards by the diverter 8 along the paper path indicated in dash-dotted lines. Having left the transport rollers 9, 10 the sheets drop into the collecting bin 6 by gravity where they are collected in superposed position on a depositing surface 15 while abutting with and registering their leading edges against a stop member 14. In the area of stop member 14 a known stapler 20 is arranged (not illustrated). Stop member 14 is movable so as to permit a stapled set of sheets 23 to slide further down for removal.

Bin 6 is designed for selectively collecting a plurality of sheet sizes of which, for the sake of clarity, only two will be described, i.e. a long one and a short one.

The mode represented in the drawing permits deposition of a short sheet format. Both the long and the short sheets are collected abutting with, and registering their leading edges against the same stop member 14 associated with the stapler 20. As far as the trailing edges of the deposited sheets are concerned, care must be taken that they do not obstruct the entry path of subsequent latter incoming or following sheets to be deposited on the stack.

For this purpose, a guide element 19, with a free end terminating immediately before the trail-edge end of the surface 15, is arranged in the plane of the depositing surface 15 of bin 6. The guide element 19, as shown, can then be pivoted upwardly about a pin 18. A cam 17 that can be rotated about a pin 16 serves to pivotably move the free end of element 19 upwards to the position shown in the drawing where it forms a drop-off point for the sheets. Due to the ramp-like orientation of guide element 19, pivoted as such, the subsequent incoming sheets are directed onto the top of the accumulating sheet stack 23, 23*a*.

During the copying process the sheets are influenced by heat, pressure, static charge and the transport means, and are therefore subject to curl affecting deposition such that the trailing or trail-edge portion of the stack facing subsequent incoming sheets usually turns up so as to exceed the normal height of the stack thereby resulting in the closing or obstruction of the entry path of subsequent incoming sheets. In the case of long sheets—due to their increased weight—this curl is less critical than in the case of short sheets. The curl of the sheet deposited which remains particularly distinct with short sheets leads to the fact that the stack portion facing the incoming sheets is turned up so as to obstruct entry of the subsequent incoming sheets.

As is apparent from the drawing, the depositing surface 15 of collecting bin 6 is arranged at an angle $\alpha$ of less than 45°. Due to such a strongly inclined position of bin 6, 15, the influence of the paper weight on the planeness of the sheets is further reduced so that a strong sheet curling may lead to an uncontrolled stack height in the sheet entry area.

A steeper arrangement of the guide element 19 could result in such a height of paper entry that the incoming sheets do not hit the bent-up trailing stack portion. This would, however, entail the disadvantage that the incoming sheets would be deflected from their intended path of movement to the extent that they are not directed towards the sheet stack, but away therefrom so that they would not abut against stop member 14. Moreover, the structural height of collecting bin 6 would substantially increase by such measures so that the advantageous spatial utilization achieved by the inclined arrangement of bin 6 would partly get lost again.

In order to both guarantee functional reliability when depositing comparatively strongly curled sheets and achieve an advantageous spatial utilization, according to the invention a plurality of rollers 22 rotatable about an axis 21 are arranged near the trailing portion of the sheet stack 23, 23*a* to be formed. The rollers 22 which are jointly driven to contact an incoming sheet in the direction of arrow "B" are arranged in spaced relation to the depositing surface 15 of bin 6 such that with regard to the guide element 19 the height of the bent-up portion 23*a* of sheet stack 23 is held or confined to a recessed position so that incoming sheets cannot hit the curled trailing edges of sheets already deposited, but are always reliably deposited on top of the stack 23, 23*a*.

A sheet entering the collecting bin 6 by the influence of gravity thus slides over the guide element 19, which when pivoted causes the sheet to contact the roller(s) 22 at a point below the axis of rotation of the roller, that is, at a point between the axis of rotation of the roller and the depositing surface 15. The sheet then is deflected and directed between rollers 22 and the top of stack 23 until it drops off the element 19 and is moved down to hit stop member 14.

As long as only a few sheets have been deposited on the surface 15, and the guide element 19 is not pivoted as shown, the curling of the sheets, which also largely depends on the type of paper (thin/thick), will not yet cause incoming sheets to contact the rollers 22. Depending on external influences and the type of paper, this situation may continue until a complete stack of sheets is formed. In this case, the rollers 22 as part of the means defining the sheet entry path, act merely as guide rollers which do not hinder the depositing procedure because relative to the incoming sheets, they rotate in a direction corresponding to the feed direction of such sheets (direction of arrow "B") and at a speed corresponding to the entering speed of the sheets.

If, however, due to the curling, the trail-edge portion of the growing stack of sheets tends to fan out excessively, the bent-up portion 23*a* of the stack 23 will contact the peripheral portion of the rollers 22 which faces the stack. Such contact will enable the roller 22 to prevent the stack 23, 23*a* from further growth in this area, and thus will guarantee that the curled up, trail-edge portion of the stack will not obstruct the entry path of subsequent incoming sheets which thus will have continued reliable entry. When the stack 23, 23*a* contacts the rollers 22, the rollers 22 then, as part of the means defining the sheet entry path, also act as transport rollers for deflecting the incoming sheet and advancing it towards stop member 14.

On the upper side of the stack of sheets a known flexible jogger (not illustrated) is additionally arranged, positioned between rollers 22 and the stop member 14 and driven in the direction of sheet entry, said jogger—by friction—reliably advancing the incoming sheets to the stop member 14 and also to a lateral boundary means (not illustrated)

As soon as a sheet on top of a stack 23*a* of sheets has reached stop member 14, the rollers 22 start slipping on that sheet. Rotating speed, diameter and surface friction coefficient of rollers 22 are adjusted such that the incoming sheets are advanced without any delay but after hitting stop member 14 no further advancing action is exerted on the sheets.

When the desired number of sheets has entered collecting bin 6, the stapler 20 is activated to staple stack 23. After stapling, stop member 14 is moved aside so that the stapled stack 23 slides down by gravity and the assistance of the jogger. Then a transport drum 24 engages the stapled stack 23 and advances it to a collecting bin (not illustrated) oriented in a similar position as the upper bin 4 and arranged beneath transport drum 24.

If long sheets are to be processed, control cam 17 is actuated to the pivot guide element 19 to an inoperative position parallel to the depositing surface 15. After leaving transport rollers 9, 10, the incoming sheets also slide downwards by gravity and are registered by the said jogger at stop member 14 and a lateral boundary means. Since the long sheets, as already indicated, due to their higher weight and flexibility show less curl when deposited, no additional measures with respect to a restriction of sheet curling are required. The guiding surface of diverter 8 deflecting the sheets entering in the direction of the arrow "A" to the paper path 13 is arranged in spaced relation to depositing surface 15 of bin 6 such that the leading portion of the long sheets is reliably guided onto the top of already deposited sheets. As is apparent from the drawing, the stack of sheets 25 already collected does not hinder the subsequently incoming sheets.

The arrangement and design of the rollers 22 according to the invention is described in conjunction with a downwardly inclined collecting bin 6 which is arranged at a steep angle and in which, as explained, the degree of sheet curling is particularly high At a less inclined position or at a substantially horizontal arrangment (not illustrated) of a collecting bin, however, the arrangement of the rollers 22 according to the invention can also be used advantageously for limiting the height of the trail-edge portion of the sheet stack facing the entry area. In such an arrangement of the bin deviating from the preferred embodiment, additional advancing means are required for the sheets which then are no longer moved by gravity. The described advantageous effect of the roller and the low structure of the bin are thereby not impaired.

In addition to the processing of long and short sheets selected for a simplified description of the invention, of course, a range of other sheet formats can also be processed. For example, with the apparatus set to the short format, a format range between 8"×9" and 8,5"×11" can be processed with one and the same arrangement of the rollers 22.

The rollers 22, as described, can be stationary or movably adjustable. For example, it is possible to design the rollers 22 so as to be adjustable in the direction of sheet entry (not illustrated), so that they can be optimally associated with the trailing-edge portion of the different sheet formats. Equally, several guide elements 19 can be provided which are associated to different sheet formats and can selectively be pivoted.

The guide elements 19 can, of course, also be designed so as to be adjustable in sheet entry direction or inserted in the sheet entry path transverse thereto (not illustrated).

When setting the sheet format to be processed, it is also possible to move a roller arrangement such as rollers 22 according to the preferred embodiment from an inoperative position to an operative position associated with the trailing portion of the respective sheet stack to be formed (not illustrated).

The invention has been described in detail with particular reference to a presently preferred embodiment, but it will be understood that variations and modifications can be effected within the spirit and scope of the invention.

What is claimed is:

1. Apparatus for collecting sheets fed seriatim into a stack, the apparatus including:

(a) a sheet depositing surface for receiving and holding the collected sheets in the stack;

(b) stop means located at a lead-edge end of said sheet depositing surface for registering the lead edge of each incoming sheet; and (c) means defining an entry path for an incoming sheet being fed on top of the stack of sheets on said sheet depositing surface, said sheet entry path defining means including:

(i) a sheet guide element for guiding incoming sheets on top of said stack on said depositing surface, said guide element being arranged to terminate immediately before a trail-edge end of said depositing surface and at a sheet drop-off point, said guide element defining part of a sheet entry plane at said drop-off point; and (ii) a rotatable sheet deflection roller for contacting and deflecting an incoming sheet on top of said stack, and for retaining a trail-edge portion of said stack in a recessed position below said sheet drop-off point, said sheet deflection roller being mounted spaced from the trail-edge end of said depositing surface so as to be capable of deflecting and retaining the trail-edge portion of long sheets touching such trail-edge end, and of shorter sheets spaced from such trail-edge end.

2. The apparatus of claim 1 wherein said deflection roller is mounted over the trail-edge portion of said stack of sheets and is rotatable so as to contact an incoming sheet in the direction of sheet travel, and wherein said sheet deflection roller is mounted spaced from the trail-edge end of said sheet depositing surface such that a peripheral portion thereof facing said depositing surface lies below said sheet drop-off point, and such that an incoming sheet will contact said roller at a point thereon between its axis of rotation and said depositing surface.

3. The apparatus of claim 1 wherein said sheet depositing surface and said sheet guide element are arranged to have a downwardly slanting orientation relative to the direction of travel of an incoming sheet.

4. The apparatus of claim 1 wherein said sheet deflection roller is movable relative to the trail-edge end of said depositing surface so as to effectively handle a range of different sheet sizes.

5. Apparatus according to claim 1, characterized in that said roller, relative to its range of action, can be set to handle different sheet formats or format ranges.

6. Apparatus for depositing sheets fed individually into a bin and collected therein into a stack, said bin having a depositing surface and a stop means for registering the leading edge of the incoming sheets, the sheet depositing apparatus comprising at least one guide element arranged opposite said stop means upstream, relative to sheet movement, of the trailing end of the sheet stack for guiding the sheets fed into the bin onto sheets already deposited in the stack, and further comprising a trail-end confining roller driven in sheet entry direction, and arranged in spaced relation to the depositing surface for engaging the trailing end of the sheet stack, characterized in that:

(a) the sheet depositing surface is arranged at an angle of less than 45°, relative to vertical, and inclined towards the stop means;

(b) the guide element is a ramp ascending from the depositing surface towards said trail-end confining roller such that the end portion of said guide element facing said roller is located above a bent-up portion of the trailing end of the sheet stack;

(c) the peripheral section of said roller facing the sheet stack lies beneath the sheet entry plane determined by said end of the guide element facing said roller for limiting the top surface and trailing end of the sheet stack in the area of its bent-up portion into a position beneath the sheet entry plane so as not to obstruct sheets from being fed into the bin, and said peripheral section of said roller being at a distance above the depositing surface that exceeds the maximum height of the sheet stack but permits the trailing end of the sheet stack to bend up between said roller and the depositing surface; and (d) said roller is arranged at a distance from said guide element of the collecting bin so as to be capable of confining both the trailing portion of a stack of short sheets and the trailing portion of a stack of long sheets into a recessed position below the sheet entry plane, thereby keeping the sheet feed path open.

* * * * *